US009605637B2

(12) United States Patent
Takada et al.

(10) Patent No.: US 9,605,637 B2
(45) Date of Patent: Mar. 28, 2017

(54) FUEL INJECTION VALVE

(71) Applicants: TOYOTA JIDOSHA KABUSHIKI KAISHA, Toyota-shi, Aichi-ken (JP); KABUSHIKI KAISHA TOYOTA JIDOSHOKKI, Kariya-shi, Aichi-ken (JP)

(72) Inventors: Noriyuki Takada, Susono (JP); Tsutomu Kawae, Kariya (JP)

(73) Assignees: Toyota Jidosha Kabushiki Kaisha, Toyota-shi, Aichi-ken (JP); Kabushiki Kaisha Toyota Jidoshokki, Kariya-shi, Aichi-ken (JP)

( * ) Notice: Subject to any disclaimer, the term of this patent is extended or adjusted under 35 U.S.C. 154(b) by 0 days.

(21) Appl. No.: 14/870,253

(22) Filed: Sep. 30, 2015

(65) Prior Publication Data

US 2016/0097359 A1 Apr. 7, 2016

(30) Foreign Application Priority Data

Oct. 1, 2014 (JP) ..... 2014-203392

(51) Int. Cl.
*F02M 61/18* (2006.01)
*F02M 61/14* (2006.01)
*F02M 61/04* (2006.01)

(52) U.S. Cl.
CPC ..... *F02M 61/14* (2013.01); *F02M 61/04* (2013.01); *F02M 61/1806* (2013.01); *F02M 61/1833* (2013.01); *F02M 61/1846* (2013.01)

(58) Field of Classification Search
CPC ..... F02M 61/1826; F02M 61/1806; F02M 61/1833; F02M 61/14; F02M 61/04;
(Continued)

(56) References Cited

U.S. PATENT DOCUMENTS 8,360,338 B2 * 1/2013 Gunji ..... F02M 61/168 239/5
8,905,333 B1 * 12/2014 Sykes ..... F02M 61/1833 239/5

(Continued)

FOREIGN PATENT DOCUMENTS

EP 2 264 307 A1 12/2010
EP 2 765 303 A1 8/2014

(Continued)

*Primary Examiner* — Steven J Ganey
*Assistant Examiner* — Juan C Barrera
(74) *Attorney, Agent, or Firm* — Finnegan, Henderson, Farabow, Garrett & Dunner, LLP

(57) ABSTRACT

An object of the present invention is to improve the exhaust emission for a fuel injection valve having a stepped injection hole constructed so that a small diameter portion and a large diameter portion are communicated with each other with a stepped portion intervening therebetween. The present invention resides in a fuel injection valve comprising a cylindrical nozzle body which has a tip portion formed to have a conical shape, an injection hole which penetrates from an inner circumferential surface to an outer circumferential surface of the nozzle body, the injection hole being constructed so that a small diameter portion, which is positioned on a side of the inner circumferential surface of the nozzle body, is communicated with a large diameter portion which is positioned on a side of the outer circumferential surface of the nozzle body, with a stepped portion intervening therebetween, and a valve plug which is accommodated slidably in the nozzle body and which opens/closes the injection hole, wherein a ratio of the hole diameter of the large diameter portion with respect to the hole diameter of the small diameter portion is not less than 3.1 and not more than 4.0, a ratio of a length of the large diameter portion with respect to a length of the small diameter portion is not less than 0.25 and not more than 0.55, and a ratio of the length
(Continued)

of the large diameter portion with respect to the hole diameter of the large diameter portion is not less than 0.4 and not more than 1.6.

3 Claims, 15 Drawing Sheets

(58) Field of Classification Search
CPC ..... F02M 61/1846; F02M 61/1873; B05B 1/265; B05B 1/262
USPC .... 239/533.12, 601, 499, 500; 123/305, 294
See application file for complete search history.

(56) References Cited

U.S. PATENT DOCUMENTS

2007/0012805 A1* 1/2007 Maier ..... F02M 51/0671 239/533.12
2009/0025680 A1* 1/2009 Kihara ..... F02B 23/104 123/299
2009/0242668 A1* 10/2009 Higuma ..... B21K 1/20 239/584
2009/0272824 A1* 11/2009 Kitagawa ..... F02M 51/061 239/585.5
2010/0193612 A1* 8/2010 Schrade ..... F02M 51/0671 239/533.12
2014/0151468 A1* 6/2014 Yasukawa ..... F02M 61/1813 239/562
2014/0190451 A1* 7/2014 Vorbach ..... F02M 61/06 123/445
2015/0047611 A1 2/2015 Yasukawa et al.

FOREIGN PATENT DOCUMENTS

FR 2 968 720 A1 6/2012
JP 2004-245194 9/2004
JP 2007-107459 4/2007
JP 2013-199876 10/2013

* cited by examiner

FUEL INJECTION VALVE

BACKGROUND OF THE INVENTION

Technical Field

The present invention relates to a fuel injection valve for an internal combustion engine. In particular, the present invention relates to a fuel injection valve for injecting fuel into a cylinder of an internal combustion engine.

Description of the Related Art

A fuel injection valve for injecting fuel into a cylinder of an internal combustion engine is known, comprising a cylindrical nozzle body which has a tip portion formed to have a conical shape, injection holes which penetrate from an inner circumferential surface to an outer circumferential surface of the nozzle body, and a valve plug which is accommodated slidably in the nozzle body and which opens/closes the injection holes, wherein the injection hole is formed so that a small diameter portion, which is arranged on a side of the inner circumferential surface of the nozzle body, is communicated with a large diameter portion which is arranged on a side of the outer circumferential surface of the nozzle body and which has a hole diameter larger than that of the small diameter portion, with a stepped portion (difference in, diameter) intervening therebetween (see, for example, Patent Literatures 1-3).

CITATION LIST

Patent Literature

Patent Literature 1: Japanese Patent Application Laid-Open No, 2007-107459

Patent Literature 2: Japanese Patent Application Laid-Open No. 2004-245194

Patent Literature 3 Japanese Patent Application Laid-Open No. 2013-199876

SUMMARY OF THE INVENTION

Technical Problem

In the meantime, in the case of the conventional technique described above, the fine particulate formation and the spraying angle of the injected fuel are taken into consideration, but the penetration of the injected fuel is not taken into consideration. Therefore, there is such a possibility that the effect of the provision of the large diameter portion at the outlet portion of the injection hole is not sufficiently obtained. Therefore, there is also such a possibility the exhaust emission cannot be sufficiently improved as compared with a fuel injection valve which has no large diameter portion provided at the outlet portion of the injection hole.

The present invention has been made taking the foregoing actual circumstances into consideration, an object of which is to provide such a technique that the exhaust emission can be improved for a fuel injection valve having an injection hole constructed so that a small diameter portion and a large diameter portion are communicated with each other with a stepped portion (difference in diameter) intervening therebetween.

Solution to Problem

In order to solve the problem as described above, the present invention has adopted the following means. That is, the present invention resides in a fuel injection valve for injecting fuel into a cylinder of an internal combustion engine, comprising a cylindrical nozzle body which has a tip portion formed to have a conical shape, an injection hole which penetrates from an inner circumferential surface to an outer circumferential surface of the nozzle body, and a valve plug which is accommodated slidably in the nozzle body and which opens/closes the injection hole, wherein:

the injection hole is constructed so that a small diameter portion, which is positioned on a side of the inner circumferential surface of the nozzle body, is communicated with a large diameter portion which is positioned on a side of the outer circumferential surface of the nozzle body and which has a hole diameter larger than that of the small diameter portion, with a stepped portion intervening therebetween;

a ratio of the hole diameter of the large diameter portion with respect to the hole diameter of the small diameter portion is not less than 3.1 and not more than 4.0;

a ratio of a length of the large diameter portion with respect to a length of the small diameter portion is not less than 0.25 and not more than 0.55; and a ratio of the length of the large diameter portion with respect to the hole diameter of the large diameter portion is not less than 0.4 and not more than 1.6.

According to the fuel injection valve constructed as described above, it is possible to lengthen the penetration when the fuel injection pressure is high and the fuel injection amount is large while suppressing the penetration to be equivalent when the fuel injection pressure is low and the fuel injection amount is small, as compared with a fuel injection valve in which any large diameter portion is not provided at an outlet portion of an injection hole (in other words, a fuel injection valve having an injection hole constructed by only a small diameter portion). Further, according to the fuel injection valve constructed as described above, it is possible to increase the spraying angle as compared with a fuel injection valve in which any large diameter portion is not provided at an outlet portion of an injection hole.

When the penetration having the characteristic as described above can be realized, the injected fuel hardly adheres to the cylinder bore wall surface when the fuel injection pressure is low and the fuel injection amount is small. Therefore, the amount of the unburned fuel component (for example, hydrocarbon (HC)), which is discharged from the internal combustion engine, is decreased. Further, when the fuel injection pressure is high and the fuel injection amount is large, the injected fuel is mixed with a larger amount of the air existing in the combustion chamber. Therefore, the amount of fuel, which is combusted in a state of oxygen deficiency, is decreased. The amount of smoke, which is discharged from the internal combustion engine, is decreased. Further, the mist formation of the injected fuel is facilitated owing to the effect of enlarging the spraying angle. Therefore, the uniform mixing is facilitated between the fuel and the air, and the amounts of discharge of the unburned fuel and the smoke are further decreased.

Therefore, according to the fuel injection valve of the present invention, it is possible to improve the exhaust emission as compared with any fuel injection valve in which the large diameter portion is not provided at the outlet portion of the injection hole.

Note that the fuel injection valve of the present invention is preferably usable for the internal combustion engine in which the fuel injection pressure is adjusted at least within a range of 40 MPa to 180 MPa.

Advantageous Effects of Invention

According to the present invention, it is possible to improve the exhaust emission in relation to the fuel injection valve having the injection hole constructed so that the small diameter portion and the large diameter portion are communicated with each other with the stepped portion intervening therebetween.

Further features of the present invention will become apparent from the following description of exemplary embodiments with reference to the attached drawings.

DESCRIPTION OF EMBODIMENTS

An explanation will be made below on the basis of the drawings about a specified embodiment of the present invention. For example, the dimension or size, the material, the shape, and the relative arrangement of each of constitutive parts or components described in the embodiment of the present invention are not intended to limit the technical scope of the invention only thereto unless specifically noted.

Figure 1:
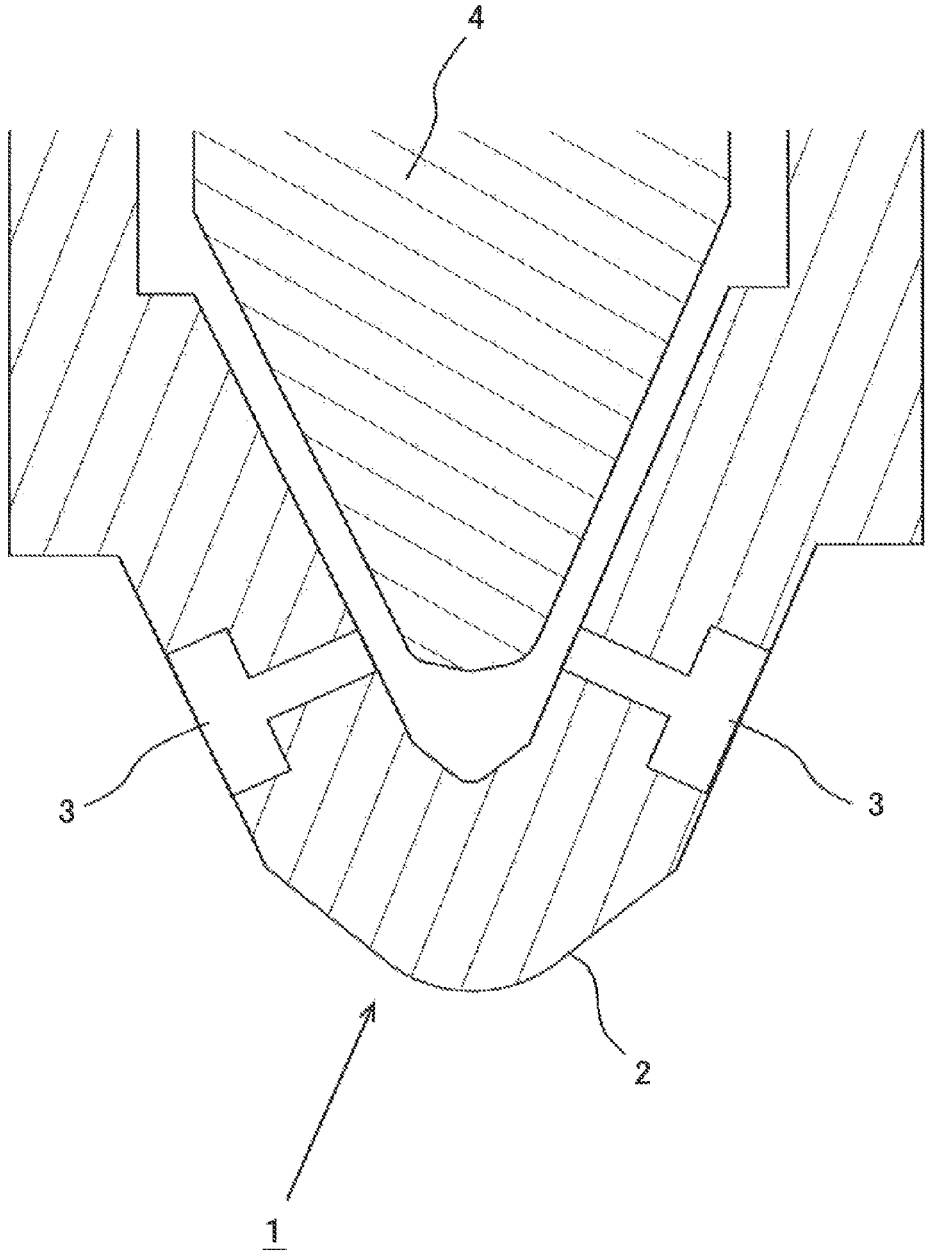
FIG. 1 shows an arrangement of main portions of a fuel injection valve to which the present invention is applied.

FIG. 1 shows an arrangement of main portions of a fuel injection valve according to the present invention. The fuel injection valve 1 shown in FIG. 1 injects, into a cylinder, liquid fuel such as light oil, gasoline or the like as the fuel for an internal combustion engine. The fuel injection valve 1 injects the fuel discharged from a mechanical pump driven by utilizing the output of the internal combustion engine (rotational force of a crank shaft).

With reference to FIG. 1, the fuel injection valve 1 is provided with a cylindrical nozzle body 2 which has a tip formed to have a conical shape. A plurality of injection holes 3, which penetrate from the inner circumferential surface to the outer circumferential surface of the nozzle body 2, are provided in the vicinity of the tip of the nozzle body 2. Further, a needle (valve plug) 4, which is provided to open/close the injection holes 3, is accommodated slidably in the nozzle body 2.

Figure 2:
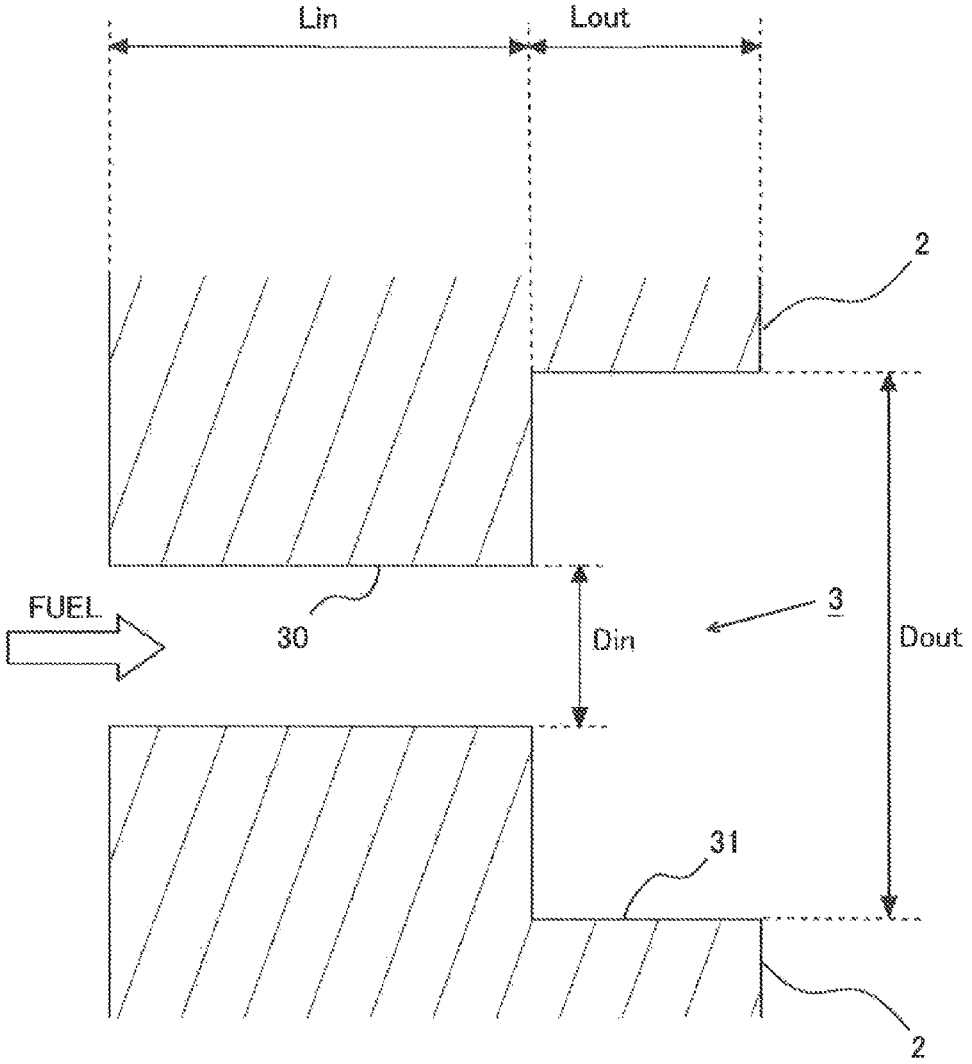
FIG. 2 shows a detailed arrangement of an injection hole.

In this context, a detailed arrangement of the injection hole 3 is shown in FIG. 2. The injection hole 3 has a small diameter portion 30 which is arranged on the inlet side in the flow direction of the fuel, and a large diameter portion 31 which is arranged on the outlet side in the flow direction of the fuel and which has a hole diameter larger than that of the small diameter portion 30. The small diameter portion 30 and the large diameter portion 31 are communicated with each other with a stepped portion (difference in diameter) intervening therebetween. Note that Din shown in FIG. 2 indicates the hole diameter of the small diameter portion 30, and Dout shown in FIG. 2 indicates the hole diameter of the large diameter portion 31. Further, Lin shown in FIG. 2 indicates the length of the small diameter portion, and Lout shown in FIG. 2 indicates the length of the large diameter portion 31.

By the way, if the size or dimension of each of the parts for constructing the injection hole 3 is carelessly decided, there is such a possibility that the effect of the provision of the large diameter portion 31 at the outlet portion of the injection hole 3 cannot be sufficiently obtained, and the exhaust emission cannot be sufficiently improved as compared with a case in which an injection hole provided with only a small diameter portion (injection hole not provided with the large diameter portion) is used.

The object of the provision of the large diameter portion 31 provided at the outlet portion of the injection hole 3 is to improve the exhaust emission by effectively utilizing the air flowing to the inside from the outside (combustion chamber) of the large diameter portion 31 and the flow of the air when the fuel is injected from the small diameter portion 30. Accordingly, in this embodiment, the injection hole 3 is constructed so that the amount of the air flowing into the large diameter portion 31 and the flow of the air are an appropriate amount and an appropriate flow. Specifically, the injection hole 3 is constructed so that the three dimension ratios, which correlate with the amount of the air flowing into the large diameter portion 31 and the flow of the air, are included in appropriate ranges. The three dimension ratios referred to herein are the ratio Dout/Din of the hole diameter of the large diameter portion 31 with respect to the hole diameter Din of the small diameter portion 30, the ratio Lout/Lin of the length Lout of the large diameter portion 31 with respect to the length Lin of the small diameter portion, and the ratio Lout/Dout of the length of the large diameter portion 31 with respect to the hole diameter of the large diameter portion 31. An explanation will be made below about preferred ranges of the three ratios.

(About Dout/Din)

Figure 3:
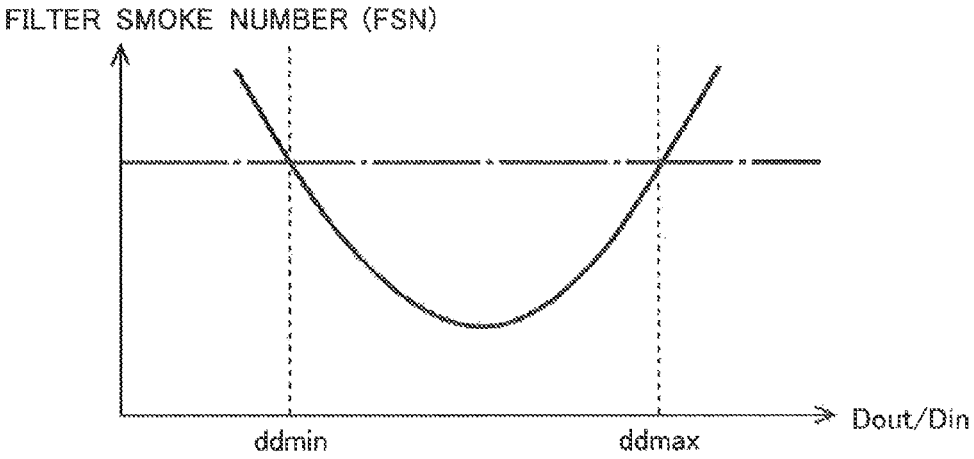
FIG. 3 shows a relationship between Dout/Din and the filter smoke number when an internal combustion engine is in a specified operation state.

FIG. 3 shows a relationship between Dout/Din and the filter smoke number (FSN) of the exhaust gas discharged from the internal combustion engine when the internal combustion engine is in a certain specified operation state. The filter smoke number referred to herein is the value which indicates the degree at which the filter is blackened by the exhaust gas containing soot allowed to pass through a predetermined filter. A solid line shown in FIG. 3 indicates the filter smoke number provided when the fuel injection valve 1 is used, which has the injection hole 3 (hereinafter referred to as "stepped injection hole 3") in which the small diameter portion 30 and the large diameter portion 31 are communicated with each other with the stepped portion intervening therebetween. Further, an alternate long and short dash line shown in FIG. 3 indicates the filter smoke number provided when a fuel injection valve is used, which has an injection hole (hereinafter referred to as "straight injection hole") which is constructed by only a small diameter portion.

As shown in FIG. 3, the filter smoke number, which is provided when the stepped injection hole 3 is used, changes like a quadratic function which is downward convex with respect to the change of Dout/Din. Accordingly, the following procedure is available. That is, the range is previously determined experimentally, in which the filter smoke number, which is provided when the stepped injection hole 3 is used, is equivalent to or less than the filter smoke number (alternate long and short dash line shown in FIG. 3) which is provided when the straight injection hole is used. The injection hole 3 is formed so that Dout/Din is included in the range. Specifically, the following procedure is available. That is, the lower limit value (ddmin shown in FIG. 3) and the upper limit value (ddmax shown in FIG. 3) of the range as described above are previously determined experimentally. The injection hole 3 is formed so that Dout/Din is not less than the lower limit value ddmin and not more than the upper limit value ddmax.

Note that the solid line shown in FIG. 3 indicates the filter smoke number provided when the internal combustion engine is in a certain specified operation state. Therefore, in order that the filter smoke number is equivalent to or less than that of the straight injection hole in the entire operation region of the internal combustion engine, it is necessary that the ranges of Dout/Din (lower limit value ddmin, upper limit value ddmax), in which the filter smoke number is not more than that of the straight injection hole, should be measured in the respective operation regions of the internal combustion engine, and the intersection (product set) of the ranges should be determined.

Figure 4:
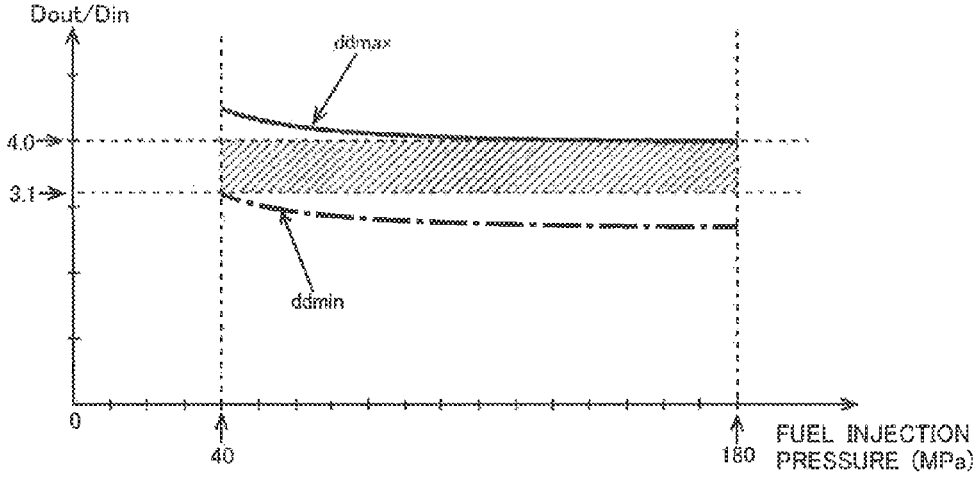
FIG. 4 shows a result of the measurement of the lower limit value ddmin and the upper limit value ddmax corresponding to each of fuel injection pressures within a fuel injection pressure range used in the entire operation region of the internal combustion engine.

FIG. 4 shows a result of the measurement of the lower limit value ddmin and the upper limit value ddmax corresponding to each of the fuel injection pressures within the fuel injection pressure range used in the entire operation region of the internal combustion engine. Note that in this embodiment, it is assumed that the fuel injection pressure in the entire operation region of the internal combustion engine is adjusted within a range of 40 MPa to 180 MPa. The horizontal axis shown in FIG. 4 represents the fuel injection pressure (MPa), and one division of the horizontal axis corresponds to 10 MPa. The vertical axis shown in FIG. 4 represents Dout/Din, and one division of the vertical axis corresponds to 1.0. Further, a solid line shown in FIG. 4 indicates a regression curve of the measurement result of the upper limit value ddmax, and an alternate long and short dash line shown in FIG. 4 indicates a regression curve of the measurement result of the lower limit value ddmin.

With reference to FIG. 4, when Dout/Din is set within a range (range hatched with oblique lines shown in FIG. 4) which is disposed between the minimum value of the upper limit value ddmax and the maximum value of the lower limit value ddmin, the filter smoke number in the entire operation region of the internal combustion engine can be suppressed to be equivalent to or less than that provided when the straight injection hole is used. Note that as shown in FIG. 4, the minimum value of the upper limit value ddmax is "4.0", and the maximum value of the lower limit value ddmin is "3.1". Therefore, it is appropriate that Dout/Din is set within a range of not less than 3.1 and not more than 4.0.

Figure 5A:
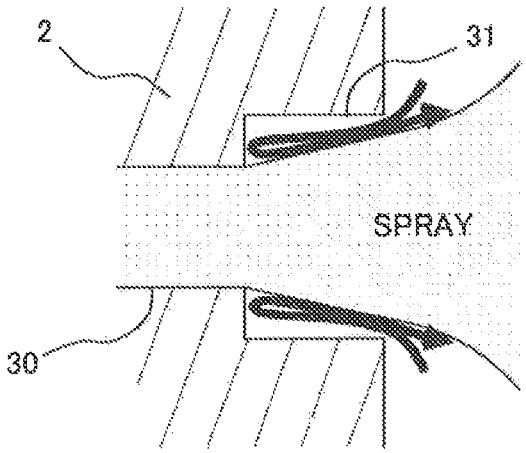
FIG. 5A shows the flow of the air around the injection hole when Dout/Din is smaller than 3.1.
Figure 5B:
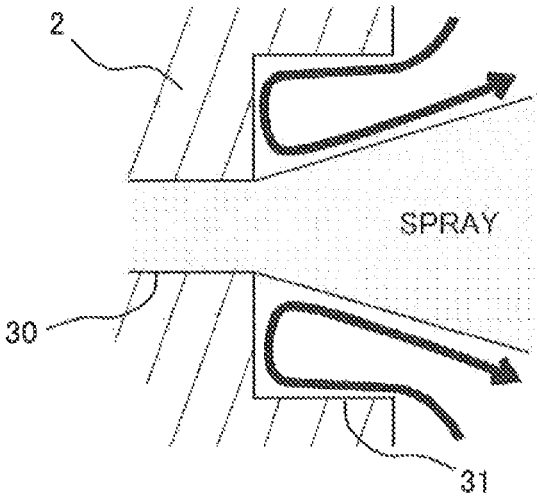
FIG. 5B shows the flow of the air around the injection hole when Dout/Din is larger than 4.0.
Figure 5C:
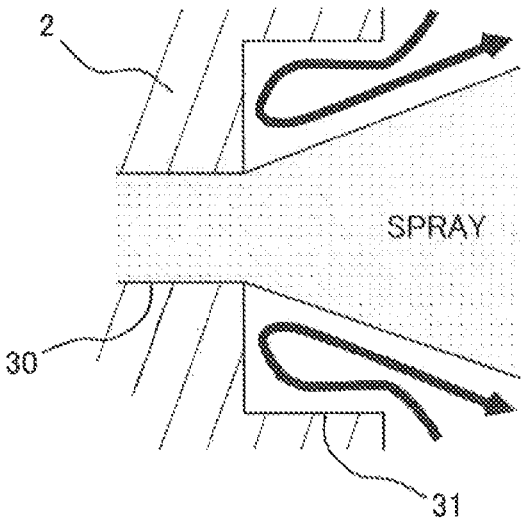
FIG. 5C shows the flow of the air around the injection hole when Dout/Din is set to be not less than 3.1 and not more than 4.0.

In this context, FIG. 5 shows the flow of the air around the stepped injection hole 3 when the fuel is injected from the fuel injection valve 1 having the stepped injection holes 3. FIG. 5A shows the flow of the air provided when Dout/Din is smaller than 3.1. FIG. 5B shows the flow of the air provided when Dout/Din is larger than 4.0. FIG. 5C shows the flow of the air provided when Dout/Din is set to be not less than 3.1 and not more than 4.0.

When the fuel is injected from the outlet of the small diameter portion 30 of the fuel injection valve 1 having the stepped injection hole 3, then the air, which has been present at the large diameter portion 31, is taken away to the outside (combustion chamber) of the large diameter portion 31 in accordance with the fuel injection, and hence the negative pressure is generated in the large diameter portion 31. When the negative pressure is generated in the large diameter portion 31, the air flows from the outside (combustion chamber) of the large diameter portion 31 into the large diameter portion 31. The air, which flows into the large diameter portion 31, flows out from the large diameter portion 31, while being incorporated into the fuel injected from the small diameter portion 30. When the air flowing out from the large diameter portion 31 and the air flowing into the large diameter portion 31 moderately interfere with each other when the flow of the air is generated as described above, then the appropriate turbulence of the airflow is generated, and the amount of air incorporated into the spray is increased. When the amount of the air incorporated into the spray is increased, then the spraying angle is enlarged, and the mixing of the fuel and the air is facilitated.

By the way, as shown in FIG. 5A, when Dout/Din is smaller than 3.1, then the air flowing out from the large diameter portion 31 inhibits the flow of the air flowing into the large diameter portion 31, and hence it is speculated that the amount of the air incorporated into the large diameter portion 31 is decreased. In particular, when the fuel injection pressure is low, the spraying angle of the fuel spouted from the small diameter portion 30 is increased. Therefore, it is speculated that the gap between the outer circumferential portion of the spray and the inner wall surface of the large diameter portion 31 is decreased, and the amount of the air incorporated into the large diameter portion 31 is further decreased. As a result, it is considered that the amount of the air incorporated into the spray is further decreased, and the fuel tends to be combusted in a state of oxygen deficiency.

Further, as shown in FIG. 5B, when Dout/Din is larger than 4.0, the air flowing into the large diameter portion 31 and the air flowing out from the large diameter portion 31 flow smoothly without interfering with each other. Therefore, it is speculated that the amount of the air incorporated into the spray is decreased, although the amount of the air flowing into the large diameter portion 31 is increased. In particular, when the fuel injection pressure is high, the spraying angle of the fuel spouted from the small diameter portion 30 is decreased. Therefore, it is speculated that the amount of the air incorporated into the spray is further decreased, although the gap between the outer circumferential portion of the spray and the inner wall surface of the large diameter portion 31 is further increased, and the amount of the air incorporated into the large diameter portion 31 is further increased. As a result, it is considered that the fuel tends to be combusted in a state of oxygen deficiency.

On the contrary, when Dout/Din is set to be not less than 3.1 and not more than 4.0, it is speculated that the air flowing out from the large diameter portion 31 interferes with the air flowing into the large diameter portion 31 to generate the moderate airflow turbulence, while permitting the inflow of the air into the large diameter portion 31 as shown in FIG. 5C. Then, it is speculated that the amount of the air incorporated into the spray is increased and the spraying angle is enlarged in accordance with the synergistic effect brought about by the air flowing into the large diameter portion 31 and the airflow turbulence as described above. As a result, it is considered that the uniform mixing of the injected fuel and the air is facilitated, and the fuel is hardly combusted in a state of oxygen deficiency.

(About Lout/Lin)

Figure 6:
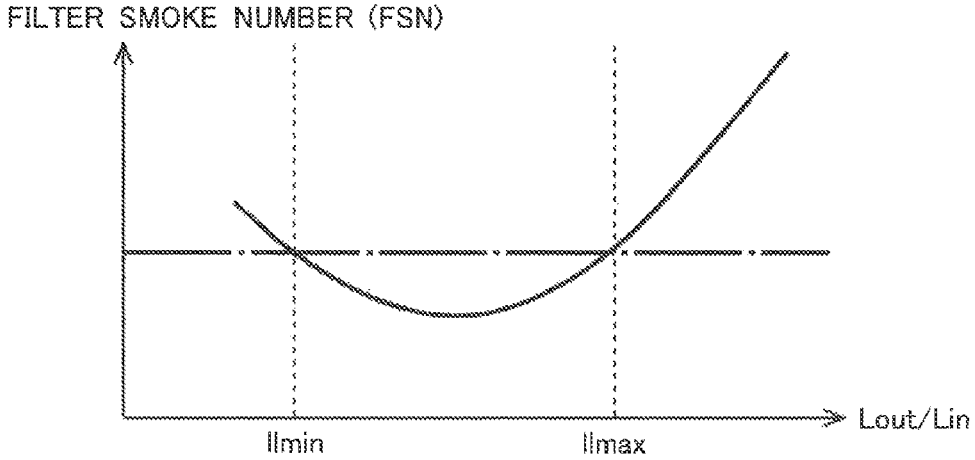
FIG. 6 shows a relationship between Lout/Lin and the filter smoke number when the internal combustion engine is in a specified operation state.

FIG. 6 shows a relationship between Lout/Lin and the filter smoke number (FSN) of the exhaust gas discharged from the internal combustion engine when the internal combustion engine is in a certain specified operation state. Note that a solid line shown in FIG. 6 indicates the filter smoke number provided when the fuel injection valve 1 having the stepped injection hole 3 is used. Further, an alternate long and short dash line shown in FIG. 6 indicates the filter smoke number provided when the fuel injection valve having the straight injection hole is used.

As shown in FIG. 6, the filter smoke number, which is provided when the stepped injection hole 3 is used, changes like a quadratic function which is downward convex with respect to the change of Lout/Lin. Accordingly, the following procedure is available. That is, the range (range from the lower limit value llmin to the upper limit value llmax shown in FIG. 6) is previously determined experimentally, in which the filter smoke number, which is provided when the stepped injection hole 3 is used, is equivalent to or less than the filter smoke number (alternate long and short dash line shown in FIG. 6) which is provided when the straight injection hole is used. The injection hole 3 is formed so that Lout/Lin is included in the range.

However, the solid line shown in FIG. 6 indicates the filter smoke number provided when the internal combustion engine is in a certain specified operation state. Therefore, it is necessary that the ranges of Lout/Lin (lower limit value llmin, upper limit value llmax), in which the filter smoke number is not more than that of the straight injection hole, should be measured in the respective operation regions of the internal combustion engine, and the intersection (product set) of the ranges should be determined, in the same manner as in the case of Dout/Din described above.

Figure 7:
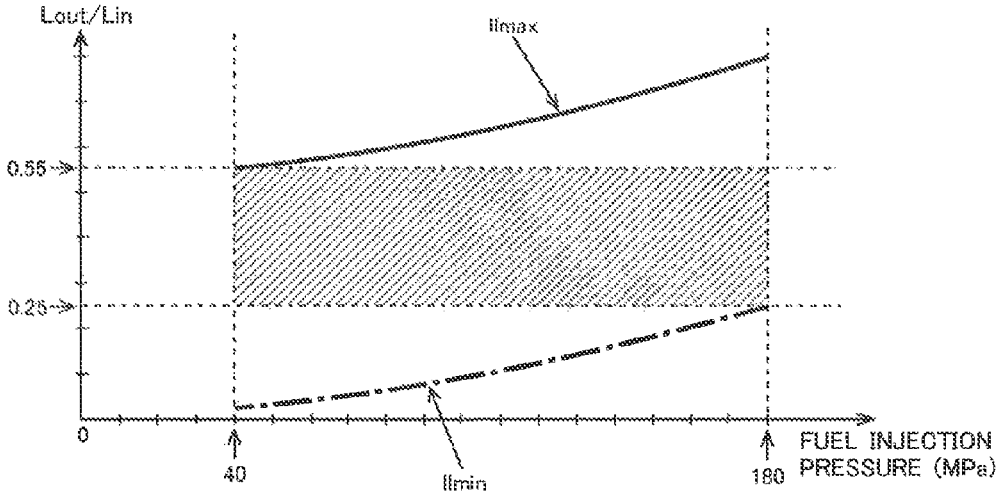
FIG. 7 shows a result of the measurement of the lower limit value llmin and the upper limit value llmax corresponding to each of fuel injection pressures within a fuel injection pressure range used in the entire operation region of the internal combustion engine.

FIG. 7 shows a result of the measurement of the lower limit value llmin and the upper limit value llmax corresponding to each of the fuel injection pressures within the fuel injection pressure range used in the entire operation region of the internal combustion engine. The horizontal axis shown in FIG. 7 represents the fuel injection pressure (MPa), and one division of the horizontal axis corresponds to 10 MPa. The vertical axis shown in FIG. 7 represents Lout/Lin, and one division of the vertical, axis corresponds to 0.1. Further, a solid line shown in FIG. 7 indicates a regression curve of the measurement result of the upper limit value llmax, and an alternate long and short dash line shown in FIG. 7 indicates a regression curve of the measurement result of the lower limit value llmin.

With reference to FIG. 7, when Lout/Lin is set within a range (range hatched with oblique lines shown in FIG. 7) which is disposed between the minimum value of the upper limit value llmax and the maximum value of the lower limit value llmin, the filter smoke number in the entire operation region of the internal combustion engine can be suppressed to be equivalent to or less than that provided when the straight injection hole is used. Note that as shown in FIG. 7, the minimum value of the upper limit value llmax is "0.55", and the maximum value of the lower limit value llmin is "0.25". Therefore, it is appropriate that Lout/Lin is set within a range of not less than 0.25 and not more than 0.55.

Figure 8A:
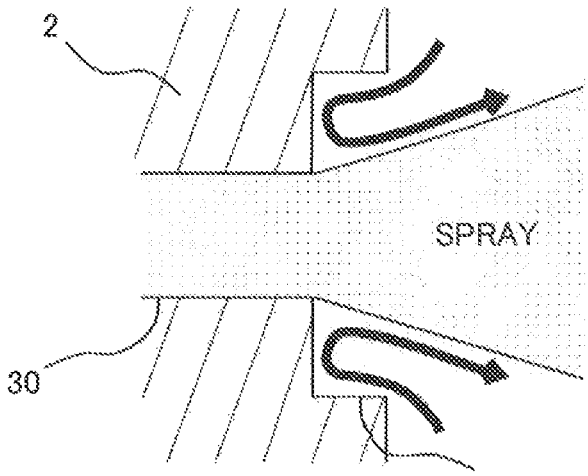
FIG. 8A shows the flow of the air around the injection hole when Lout/Lin is smaller than 0.25.
Figure 8B:
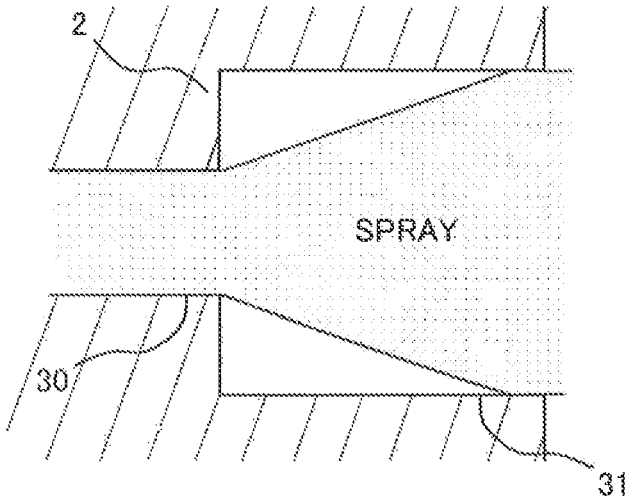
FIG. 8B shows the flow of the air around the injection hole when Lout/Lin is larger than 0.55.
Figure 8C:
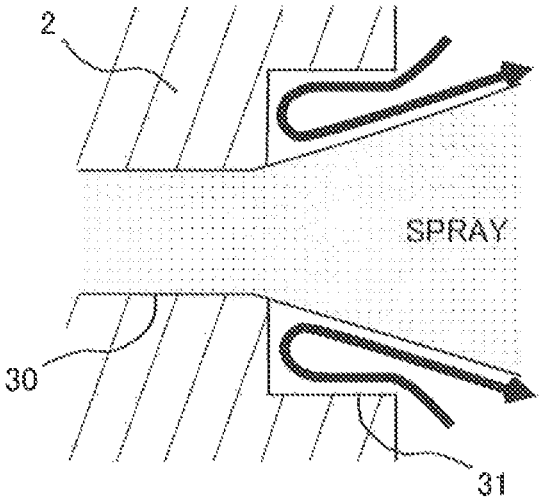
FIG. 8C shows the flow of the air around the injection hole when Lout/Lin is set to be not less than 0.25 and not more than 0.55.

In this context, FIG. 8 shows the flow of the air around the stepped injection hole 3 when the fuel is injected from the fuel injection valve 1 having the stepped injection holes 3. FIG. 8A shows the flow of the air provided when Lout/Lin is smaller than 0.25. FIG. 8B shows the flow of the air provided when Lout/Lin is larger than 0.55. FIG. 8C shows the flow of the air provided when Lout/Lin is set to be not less than 0.25 and not more than 0.55.

As shown in FIG. 8A, when Lout/Lin is smaller than 0.25, Lout is shortened. In this case, the air flowing into the large diameter portion 31 and the air flowing out from the large diameter portion 31 hardly interfere with each other and they flow smoothly. Therefore, it is speculated that the amount of the air incorporated into the spray is decreased, although the amount of the air flowing into the large diameter portion 31 is increased. As a result, it is considered that the fuel tends to be combusted in a state of oxygen deficiency.

Further, as shown in FIG. 8B, when Lout/Lin is larger than 0.55, then Lout is lengthened, and hence the spray is brought in contact with the inner circumferential surface of the large diameter portion 31. In this case, it is speculated that the air does not flow into the large diameter portion 31, and the amount of the air incorporated into the spray is decreased. As a result, it is considered that the fuel tends to be combusted in a state of oxygen deficiency.

On the contrary, when Lout/Lin is set to be not less than 0.25 and not more than 0.55, the gap between the outer circumferential portion of the spray spouted from the small diameter portion 30 and the inner circumferential surface of the large diameter portion 31 has a moderate size. In this case, it is speculated that the air flowing out from the large diameter portion 31 interferes with the air flowing into the large diameter portion 31 to generate the moderate airflow turbulence, while permitting the inflow of the air into the large diameter portion 31. Then, it is speculated that the amount of the air incorporated into the spray is increased and the spraying angle is enlarged in accordance with the synergistic effect brought about by the air flowing into the large diameter portion 31 and the airflow turbulence as described above. As a result, it is speculated that the uniform mixing of the injected fuel and the air is facilitated, and it is considered that the fuel is hardly combusted in a state of oxygen deficiency.

(About Lout/Dout)

Figure 9:
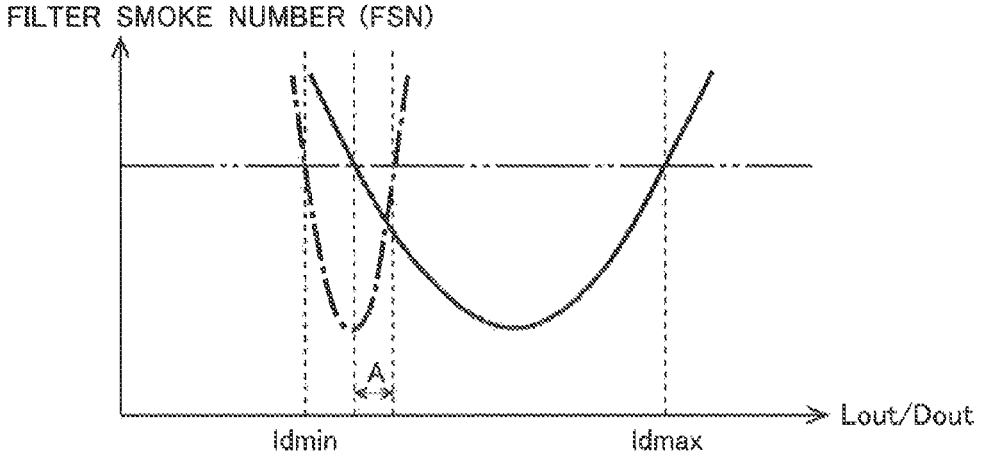
FIG. 9 shows a relationship between Lout/Bout and the filter smoke number when the internal combustion engine is in a specified operation state.

FIG. 9 shows a relationship between Lout/Dout and the filter smoke number (FSN) of the exhaust gas discharged from the internal combustion engine when the internal combustion engine is in a certain specified operation state. Note that a solid line shown in FIG. 9 indicates the filter smoke number provided when the fuel injection valve 1 having the stepped injection hole 3 is used, and Lout/Dout is changed while fixing Dout to a constant size. Further, an alternate long and short dash line shown in FIG. 9 indicates the filter smoke number provided when the fuel injection valve 1 having the stepped injection hole 3 is used, and Lout/Dout is changed while fixing Lout to a constant length. Further, an alternate long and two short dashes line shown in FIG. 9 indicates the filter smoke number provided when the fuel injection valve having the straight injection hole is used.

As shown in FIG. 9, the filter smoke number, which is provided when the stepped injection hole 3 is used, changes like a quadratic function which is downward convex with respect to the change of Lout/Dout. Accordingly, the following procedure is available. That is, the range is previously determined experimentally, in which the filter smoke number, which is provided when the stepped injection hole 3 is used, is equivalent to or less than the filter smoke number (alternate long and two short dashes line shown in FIG. 9) which is provided when the straight injection hole is used. Lout/Dout is set within the range.

For example, when Lout/Dout is changed while fixing Lout to a constant length, the range is determined, in which the filter smoke number is equivalent to or less than that provided when the straight injection hole is used. Further, when Lout/Dout is changed while fixing Dout to a constant hole diameter, the range is determined, in which the filter smoke number is equivalent to or less than that provided when the straight injection hole is used. Then, the following method is conceived. That is, a range (range A shown in FIG. 9), in which the two ranges are overlapped, is determined, and Lout/Dout is set within the range.

By the way, when the fuel injection valve 1 having the stepped injection hole 3 is produced, then the dimension of at least one of Din, Dout, Lin, and Lout is previously determined, and the dimensions of the other portions are determined on the basis of the dimension and the dimension ratio described above. For example, the maximum output of the internal combustion engine correlates with the flow velocity (flow rate per unit time) of the fuel flowing through the small diameter portion 30 during the high load operation. Therefore, the hole diameter Din of the small diameter portion 30 may be determined depending on the maximum output of the internal combustion engine. Further, it is preferable that the penetration of the injected fuel resides in the length corresponding to the cylinder bore diameter. Therefore, the length Lin of the small diameter portion 30 strongly correlated with the penetration may be determined depending on the cylinder bore diameter. When at least one of Din, Dout, Lin, and Lout is determined as described above, if Lout/Dout is restricted within the range A described above, then there is such a possibility that the operation to adjust the dimensions of the respective portions, which is performed so that Dout/Din is included in the range of not less than 3.1 and not more than 4.0 described above and Lout/Lin is included in the range of not less than 0.25 and not more than 0.55 described above, may be complicated.

In relation thereto, a method is conceived, in which the range of Lout/Dout is not prescribed. However, when Dout/Din and Lout/Lin are set within the ranges described above, if Lout/Dout is excessively small, then there is such a possibility that the amount of the air incorporated into the spray may be decreased, although the amount of the air flowing into the large diameter portion 31 is increased, in the same manner as in the case in which Lout/Lin is excessively small (FIG. 8A). Further, when Dout/Din and Lout/Lin are set within the ranges described above, if Lout/Dout is excessively large, then there is such a possibility that the air does not flow into the large diameter portion 31 and the air incorporated into the spray may be decreased, in the same manner as in the case in which Lout/Lin is excessively large (FIG. 8B).

In view of the above, in this embodiment, Lout/Dout is set within at least one range (range from the lower limit value ldmin to the upper limit value ldmax shown in FIG. 9) of the range provided when Lout is fixed to a constant length and the range provided when out is fixed to a constant hole diameter. Accordingly, the degree of freedom of the setting is enhanced for Dout/Din and Lout/Lin, while preventing Lout/Dout from being greatly deviated from the proper range.

Note that the solid line and the alternate long and short dash line shown in FIG. 9 indicate the filter smoke numbers provided when the internal combustion engine is in the certain specified operation state. Therefore, it is necessary that the lower limit value ldmin and the upper limit value ldmax should be determined in each of the operation regions of the internal combustion engine, and the intersection (product set) of the ranges specified by the lower limit value ldmin and the upper limit value ldmax should be determined, in the same manner as in the case of Dout/Din and Lout/Din described above.

Figure 10:
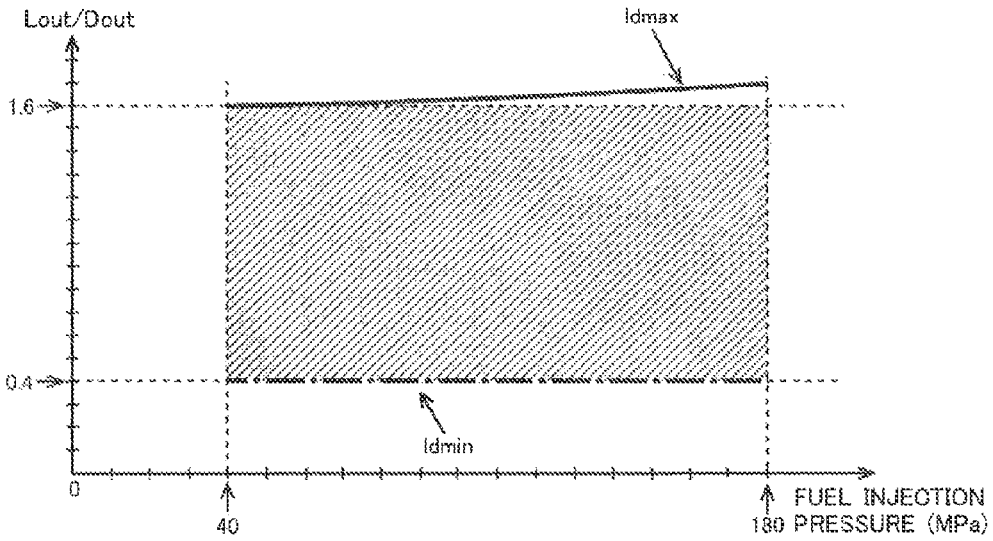
FIG. 10 shows a result of the measurement of the lower limit value ldmin and the upper limit value ldmax corresponding to each of fuel injection pressures within a fuel injection pressure range used in the entire operation region of the internal combustion engine.

FIG. 10 shows a result of the measurement of the lower limit value ldmin and the upper limit value ldmax corresponding to each of the fuel injection pressures within the fuel injection pressure range used in the entire operation region of the internal combustion engine. The horizontal axis shown in FIG. 10 represents the fuel injection pressure (MPa), and one division of the horizontal axis corresponds to 10 MPa. The vertical axis shown in FIG. 10 represents Lout/Dout, and one division of the vertical axis corresponds to 0.1. Further, a solid line shown in FIG. 10 indicates a regression curve of the measurement result of the upper limit value ldmax, and an alternate long and short dash line shown in FIG. 10 indicates a regression curve of the measurement result of the lower limit value ldmin.

With reference to FIG. 10, it is assumed that Lout/Dout is set within a range (range hatched with oblique lines shown in FIG. 10) which is disposed between the minimum value of the upper limit, value ldmax and the maximum value of the lower limit value ldmin. Note that as shown in FIG. 10, the minimum value of the upper limit value ldmax is "1.6", and the maximum value of the lower limit value ldmin is "0.4". Therefore, it is appropriate that Lout/Dout is set within a range of not less than 0.4 and not more than 1.6.

When the range of Lout/Dout is decided as described above, it is possible to simplify the operation for adjusting the dimensions of the respective portions so that Dout/Din is included in the range of not less than 3.1 and not more than 4.0 described above and Lout/Lin is included in the range of not less than 0.25 and not more than 0.55 described above.

(Effect of Stepped Injection Hole)

Figure 11:
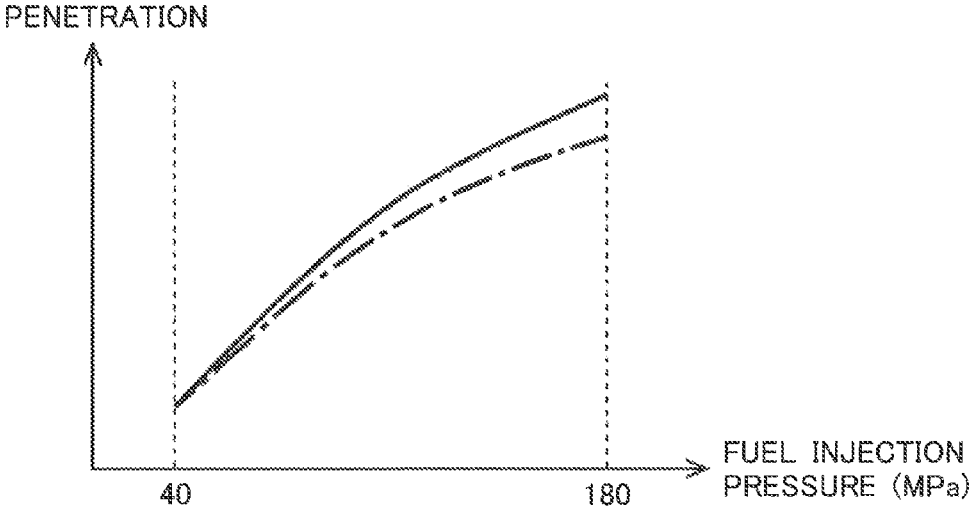
FIG. 11 shows a relationship between the fuel injection pressure and the penetration.

FIG. 11 shows a result of the measurement of the penetration at each of the fuel injection pressures when the stepped injection hole 3, which is constructed so that Dout/Din, Lout/Lin, and Lout/Dout are included in the ranges described above, is used. A solid line shown in FIG. 11 indicates a regression curve of the measurement result obtained when the stepped injection hole 3 is used. Further, an alternate long and short dash line shown in FIG. 11 indicates a regression curve of the measurement result obtained when a straight injection hole, which has the injection hole having the same diameter as that of the stepped injection hole 3, is used. Note that the length of the straight injection hole is set to such a length that the injected fuel does not arrive at the cylinder bore wall surface in the low load operation region in which the fuel injection pressure is low.

The measurement result shown in FIG. 11 indicates the fact that the penetration, which is provided when the fuel injection pressure is raised, is lengthened as compared with when the straight injection hole is used, and the penetration, which is provided when the fuel injection pressure is lowered, is equivalent to that provided when the straight injection hole is used. According to the characteristic as described above, the fuel, which adheres to the cylinder bore wall surface, is decreased when the fuel injection pressure is low. Therefore, the amount of hydrocarbon (HC), which is discharged from the internal combustion engine, is decreased. On the other hand, when the fuel injection pressure is high, the injected fuel is mixed with a larger amount of the air in the combustion chamber. Therefore, the situation, in which the fuel is combusted in a state of oxygen deficiency, is suppressed, and the amount of production of smoke is decreased.

Figure 12:
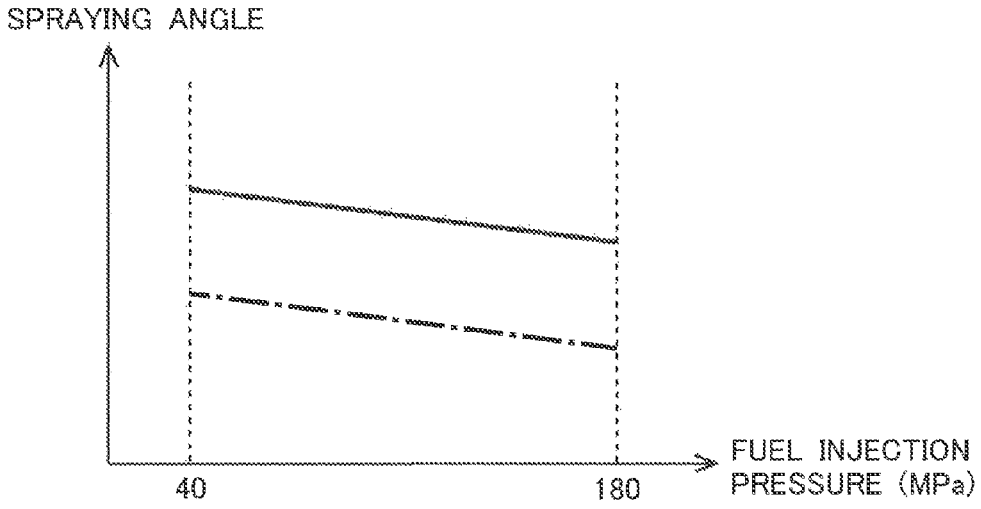
FIG. 12 shows a relationship between the fuel injection pressure and the spraying angle.

In the next place, FIG. 12 shows a result of the measurement of the spraying angle at each of the fuel injection pressures when the stepped injection hole 3, which is constructed so that Dout/Din, Lout/Lin, and Lout/Dout are included in the ranges described above, is used. A solid line shown in FIG. 12 indicates a regression line of the measurement result provided when the stepped injection hole 3 is used. An alternate long and short dash line shown in FIG. 12 indicates a regression line of the measurement result provided when the straight injection hole, which has the injection hole having the same diameter as that of the stepped injection hole 3, is used. Note that the length of the straight injection hole is set to such a length that the injected fuel does not arrive at the cylinder bore wall surface in the low load operation region in which the fuel injection pressure is low, in the same manner as in the case shown in FIG. 11.

The measurement result shown in FIG. 12 shows that the spraying angle, which is provided when the stepped injection hole 3 is used, is larger than that provided when the straight injection hole is used, in all of the regions ranging from the region in which the fuel injection pressure is lowered to the region in which the fuel injection pressure is raised. According to the characteristic as described above, it is speculated that the fine particulate formation of the fuel and the mixing of the injected fuel and the air are facilitated in the entire operation region of the internal combustion engine. As a result, the situation, in which the fuel is combusted in a state of oxygen deficiency, is suppressed, and the amounts of hydrocarbon (HC) and the smoke discharged from the internal combustion engine are decreased.

Therefore, according to the fuel injection valve 1 having the stepped injection hole 3 as described above, the amount of hydrocarbon (HC) which is discharged from the internal combustion engine when the fuel injection pressure is low and the fuel injection amount is small, can be suppressed to be small, and the amount of smoke, which is discharged from the internal combustion engine when the fuel injection pressure is high and the fuel injection amount is large, can be suppressed to be small, as compared with the fuel injection valve having the straight injection hole. Further, when the amount of the fuel adhered to the cylinder bore wall surface is decreased when the fuel injection pressure is low, then the amount of the fuel, which is subjected to the combustion, is increased, and it is also possible to suppress the fuel consumption amount to be small. Further, when the amount of the smoke discharged from the internal combustion engine is decreased when the fuel injection pressure is high and the fuel injection amount is large, then it is possible to decrease the regeneration frequency of the particulate filter arranged in the exhaust system of the internal combustion engine. The fuel consumption amount, which is required to regenerate the particulate filter, can be also suppressed to be small.

First Modified Embodiment

When the internal combustion engine is in a low load operation state, the amount of hydrocarbon (HC) discharged from the internal combustion engine tends to increase. Accordingly, it is also appropriate that the range of Lout/Lin is set so that hydrocarbon (HO discharged from the internal combustion engine in the low load operation state is decreased more reliably.

Figure 13:
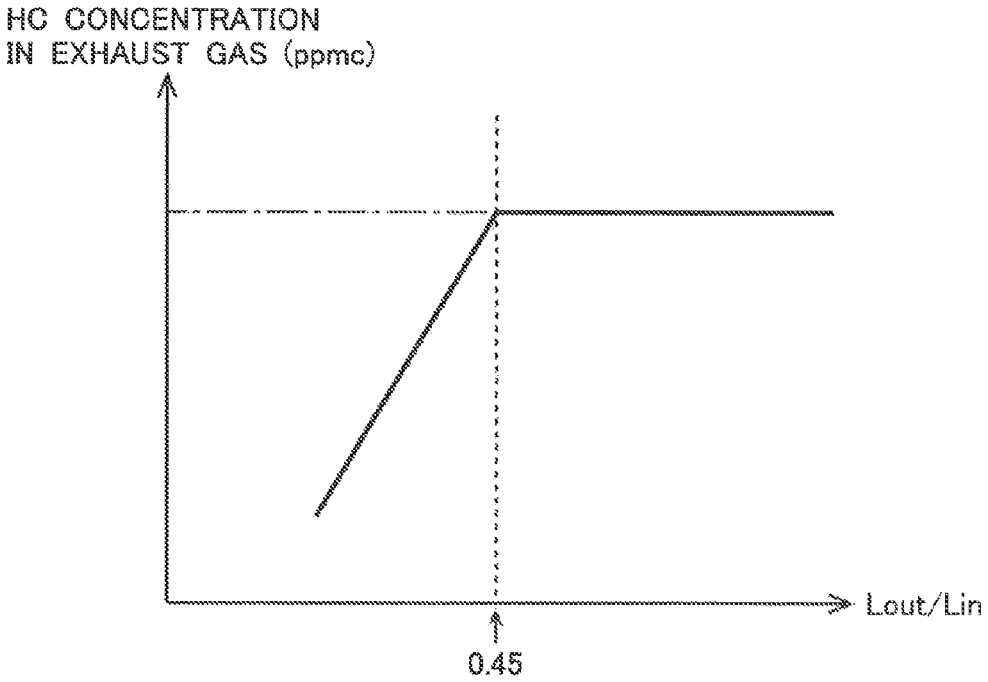
FIG. 13 shows a relationship between Lout/Lin and the HC concentration of the exhaust gas discharged from the internal combustion engine in a low load operation state.

FIG. 13 shows a relationship between Lout/Lin and the HC concentration in the exhaust gas (ppmc) provided when the internal combustion engine is in a low load operation state (for example, when the fuel injection pressure is 43 MPa). A solid line shown in FIG. 13 indicates the HC concentration provided when the stepped injection hole 3 is used, and an alternate long and short dash line shown in FIG. 13 indicates the HC concentration provided when the straight injection hole is used.

As shown in FIG. 13, when Lout/Lin is set to be not, more than "0.45", the HC concentration, which is provided when the stepped injection hole 3 is used, is not more than the HC concentration which is provided when the straight injection hole is used. Accordingly, it is also appropriate that Lout/Lin is set within a range of not less than 0.25 and not more than 0.45.

When Lout/Lin is set within the range of not less than 0.25 and not more than 0.45, the amount of hydrocarbon (HG), which is discharged from the internal combustion engine in a low load operation state, can be suppressed to be equivalent to or less than that provided when the straight injection hole is used, while suppressing the amount of production of smoke to be equivalent to or less than that provided when the straight injection hole is used.

Figure 14:
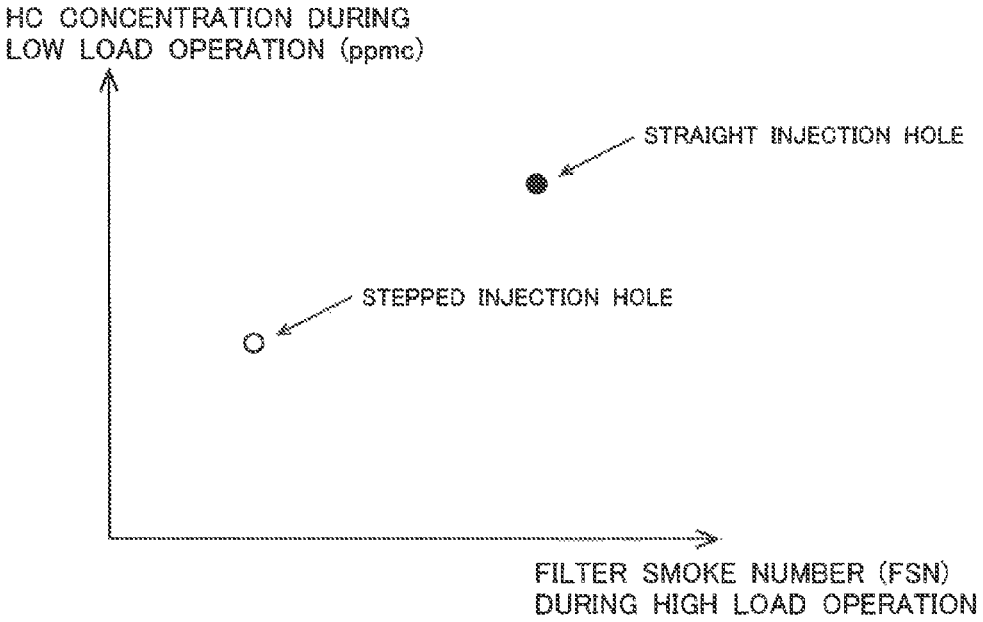
FIG. 14 shows a relationship between the filter smoke number provided during the high load operation and the HC concentration provided during the low load operation.

Further, when Dout/Din is set to be not less than 3.1 and not more than 4.0 and Lout/Dout is set to be not less than 0.4 and not more than 1.6, if Lout/Lin is set to be not less than 0.25 and not more than 0.45, then as shown in FIG. 14, the HG concentration in the low load operation region and the filter smoke number in the high load operation region, which are provided when the stepped injection hole 3 is used (white circle shown in FIG. 14), can be made smaller than those provided when the straight injection hole is used (black circle shown in FIG. 14).

Second Modified Embodiment

As described in the foregoing embodiment, when the stepped injection hole 3 is used, then the mixing of the injected fuel and the air is facilitated, and hence the combustion speed of the fuel is increased. In particular, when the combustion speed of the fuel is increased in the low load operation region, there is such a possibility that the amount of $NO_X$ discharged from the internal, combustion engine may be larger than that provided when the straight injection hole is used. In view of the above, it is also appropriate that the range of Dout/Din is set so that the increase in the $NO_X$ amount discharged from the internal combustion engine in the low load operation state is suppressed.

Figure 15:
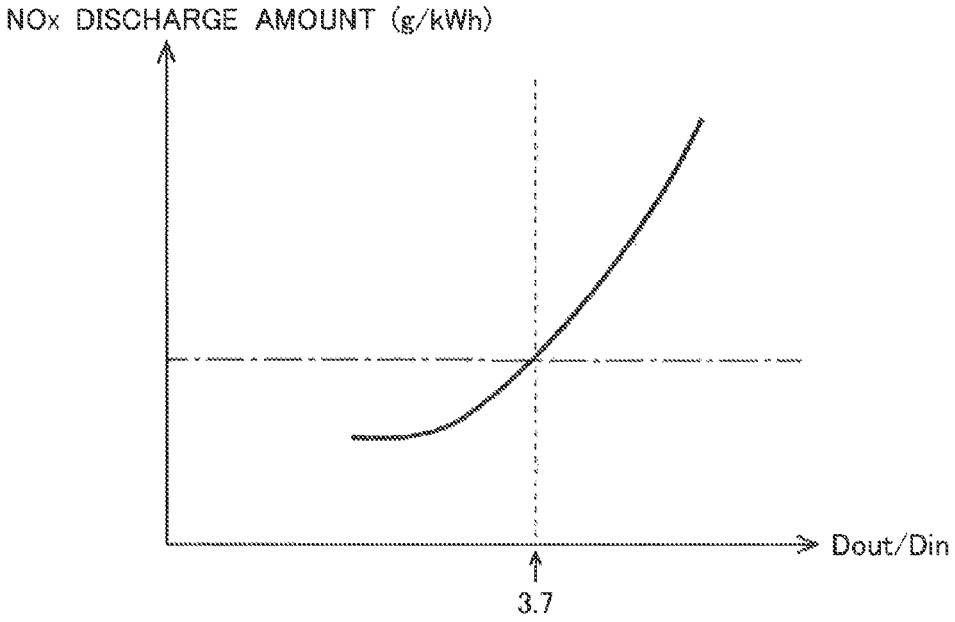
FIG. 15 shows a relationship between Dout/Din and the amount of $NO_X$ discharged from the internal, combustion engine in a low load state.

FIG. 15 shows a relationship between Dout/Din and the amount of $NO_X$ (g/kWh) discharged from the internal combustion engine when the internal combustion engine is in a low load operation state (for example, when the fuel injection pressure is 43 MPa). A solid line shown in FIG. 15 indicates the $NO_X$ amount provided when the stepped injection hole 3 is used, and an alternate long and short dash line shown in FIG. 15 indicates the $NO_X$ amount provided when the straight injection hole is used.

As shown in FIG. 15, when Dout/Din is set to be not more than "3.7", the $NO_X$ discharge amount, which is provided when the stepped injection hole 3 is used, is not more than the $NO_X$ discharge amount which is provided when the straight injection hole is used. Accordingly, it is also appropriate that Dout/Din is set within a range of not less than 3.1 and not more than 3.7.

Further, when Lout/Lin is set to be not less than 0.25 and not more than 0.55 and Lout/Dout is set to be not less than 0.4 and not more than 1.6, if Dout/Din is set to be not less than 3.1 and not more than 3.7, then it is possible to suppress the increase in the $NO_X$ amount discharged from the internal combustion engine in the low load operation state. Note that when Lout/bin is set within a range of not less than 0.25 and not more than 0.45, it is possible to suppress the increase in the $NO_X$ amount discharged from the internal combustion engine in a low load operation state, while more reliably suppressing the amount of hydrocarbon (HC) discharged from the internal combustion engine in the low load operation state to be small.

Other Embodiment

In the embodiment described above, the exemplary case has been described, in which the hole diameter of the small diameter portion is constant. However, it is also possible to use a small diameter portion having a tapered shape in which the hole diameter is gradually changed. In this case, the hole diameter provided at the outlet portion may be used for the hole diameter Din of the small diameter portion 30.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-203392, filed on Oct. 1, 2014, which is hereby incorporated by reference herein in its entirety.

REFERENCE SIGNS LIST

1: fuel injection valve
2: nozzle body
3: injection hole (stepped injection hole)
30: small diameter portion
31: large diameter portion.

The invention claimed is:

1. A fuel injection valve for injecting fuel into a cylinder of an internal combustion engine, comprising a cylindrical nozzle body which has a tip portion formed to have a conical shape, an injection hole which penetrates from an inner circumferential surface to an outer circumferential surface of the nozzle body, and a valve plug which is accommodated slidably in the nozzle body and which opens/closes the injection hole, wherein:

the injection hole is constructed so that a small diameter portion, which is positioned on a side of the inner circumferential surface of the nozzle body, is communicated with a large diameter portion which is positioned on a side of the outer circumferential surface of the nozzle body and which has a hole diameter larger than that of the small diameter portion, with a stepped portion intervening therebetween;

a ratio of the hole diameter of the large diameter portion with respect to the hole diameter of the small diameter portion is not less than 3.1 and not more than 4.0;

a ratio of a length of the large diameter portion with respect to a length of the small diameter portion is not less than 0.25 and not more than 0.55; and a ratio of the length of the large diameter portion with respect to the hole diameter of the large diameter portion is not less than 0.4 and not more than 1.6.

2. The fuel injection valve according to claim 1, wherein the length of the large diameter portion is uniform throughout the large diameter portion.

3. The fuel injection valve according to claim 1, wherein a central axis of the injection hole is oriented at an oblique angle with respect to a central axis of the nozzle body.

* * * * *